United States Patent [19]

Bhalla

[11] 4,123,685

[45] Oct. 31, 1978

[54] HID LAMP ELECTRODE COMPRISING SOLID SOLUTION OF DIBARIUM CALCIUM MOLYBDATE AND TUNGSTATE

[75] Inventor: Ranbir S. Bhalla, West Paterson, N.J.

[73] Assignee: Westinghouse Electric Corp., Pittsburgh, Pa.

[21] Appl. No.: 844,154

[22] Filed: Oct. 21, 1977

[51] Int. Cl.[2] ..... H01J 61/06

[52] U.S. Cl. ..... 313/218; 313/311; 313/346 R

[58] Field of Search ..... 313/218, 346 R, 311

[56] References Cited

U.S. PATENT DOCUMENTS

| | | | |
|---|---|---|---|
| 3,170,081 | 2/1965 | Rokasz | 313/213 |
| 4,052,634 | 10/1977 | DeKok | 313/218 X |

*Primary Examiner*—Rudolph V. Rolinec
*Assistant Examiner*—Darwin R. Hostetter
*Attorney, Agent, or Firm*—W. D. Palmer

[57] ABSTRACT

For HID lamps, and particularly high-pressure sodium-mercury HID lamps, the electron-emissive material portion of the lamp electrodes is a solid solution of dibarium calcium tungstate and dibarium calcium molybdate wherein the molar ratio of tungstate to molybdate is from 9:1 to 1:9. Emissive properties of the electrode are good and vapor pressure of emissive material is low.

5 Claims, 5 Drawing Figures

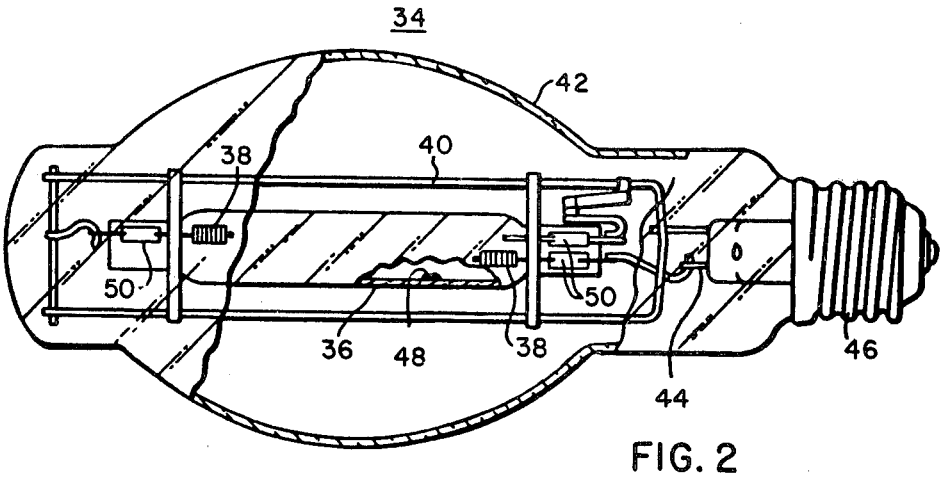
FIG. 2
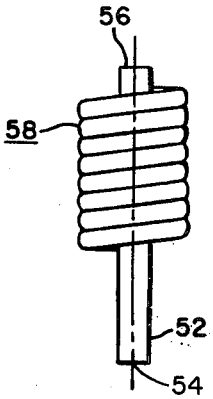
FIG. 3
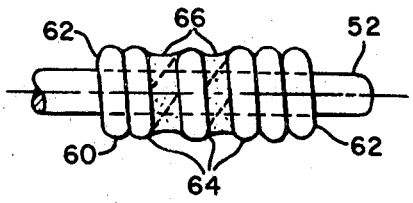
FIG. 4
FIG. 5
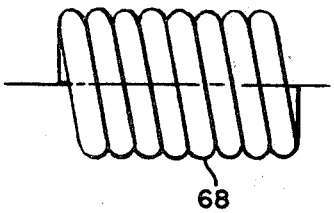

HID LAMP ELECTRODE COMPRISING SOLID SOLUTION OF DIBARIUM CALCIUM MOLYBDATE AND TUNGSTATE

BACKGROUND OF THE INVENTION

This invention relates to high-intensity-discharge (HID) lamps and, more particularly, to improved electron emissive material for the electrodes of such lamps.

In U.S. Pat. No. 3,708,710 dated Jan. 2, 1973 is disclosed a high-intensity-discharge sodium-mercury vapor lamp which utilizes dibarium calcium tungstate as electron emissive material. Such material has been used in so-called dispenser cathodes and U.S. Pat. No. 3,434,812 dated Mar. 25, 1969 discloses the use of dibarium calcium tungstate or dibarium strontium tungstate as an emissive material in a dispenser cathode.

Dibarium calcium molybdate is known for use as a getter layer material in conjunction with an incandescent lamp, as disclosed in U.S. Pat. No. 3,266,861, dated Aug. 16, 1966. In addition, high-pressure sodium-mercury vapor lamps have in the past utilized as electron emissive material a mixture of several oxide phases comprising thorium dioxide, barium thorate, dibarium calcium tungstate and barium oxide. This mixture of oxide phases is quite sensitive to the atmospheric contaminants with the result that even a brief exposure to the air can result in a relatively large pickup of water and carbon dioxide by the emission mixture, which contaminants are rather difficult to remove. In such a mixture, the thorium dioxide serves as a matrix for the more active oxide emitters such as the barium oxide, dibarium calcium tungstate and barium thorate.

SUMMARY OF THE INVENTION

There is provided in combination with an HID lamp comprising a radiation-transmitting arc tube having electrodes operatively supported therein proximate the ends thereof and adapted to have an elongated arc discharge maintained therebetween, together with means for connecting the electrodes to an energizing power source, the improved electrode structure for the lamp electrodes each of which comprises: an elongated refractory metal member having one end portion thereof supported proximate an end of the arc tube and the other end portion of the metal member projecting a short distance inwardly within the arc tube. An overfitting refractory metal coil means is carried on the inwardly projecting portion of the elongated metal member. In accordance with the invention, electron emissive material is carried intermediate turns of the overfitting coil means and the electron emissive material consists essentially of a solid solution of dibarium calcium tungstate ($Ba_2CaWO_6$) and dibarium calcium molybdate ($Ba_2CaMoO_6$) wherein the molar ratio of the tungstate to molybdate falls within the range of from 9:1 to 1:9.

BRIEF DESCRIPTION OF THE DRAWINGS

For a better understanding of the invention, reference may be had to the preferred embodiment, exemplary of the invention, shown in the accompanying drawings, in which:

FIG. 2 is an elevational view of an HID mercury-vapor lamp which incorporates the present electrodes;

FIG. 3 is an enlarged view of the electrode tip portion showing the refractory coil carried thereon;

FIG. 4 is an elevational view of the tip portion of the electrode as partially fabricated showing an inner coil which has the improved electron emissive material carried intermediate spaced turns thereof; and FIG. 5 is an elevational view of the overfitting coil which is screwed in place onto the inner coil as shown in FIG. 4 in order to complete the electrode.

DESCRIPTION OF THE PREFERRED EMBODIMENTS

Figure 1:
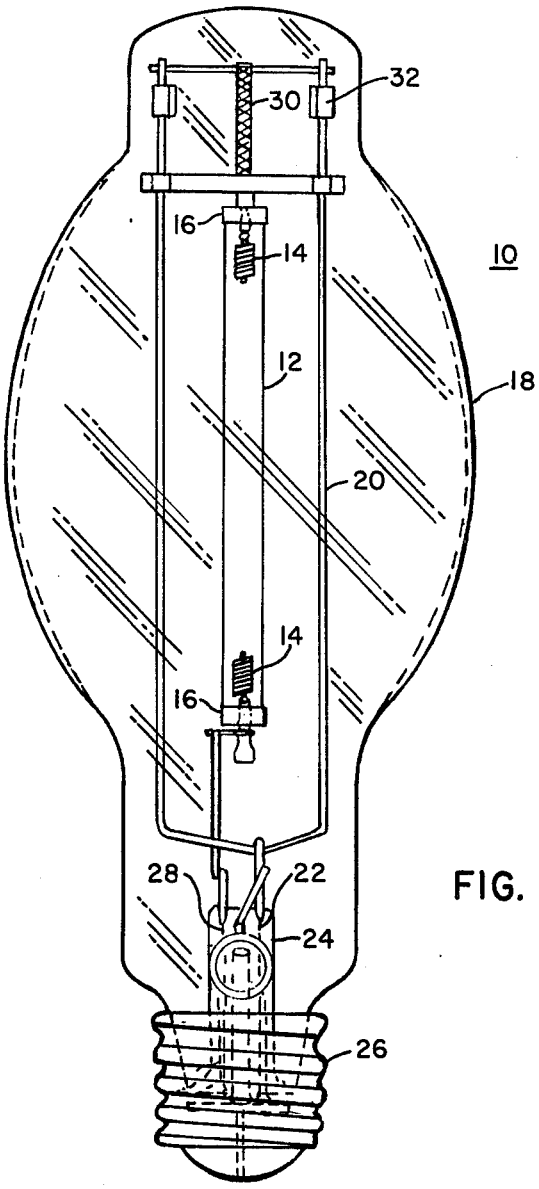
FIG. 1 is an elevational view of a typical HID sodium-mercury lamp which incorporates the present improved electrodes.

With specific reference to the form of the invention illustrated in the drawings, the lamp 10 is a typical HID sodium-mercury lamp comprising a radiation-transmitting arc tube 12 having electrodes 14 operatively supported therein proximate the ends thereof and adapted to have an elongated arc discharge maintained therebetween. The arc tube is fabricated of refractory material such as single crystal or polycrystalline alumina having niobium end caps 16 sealing off the ends thereof. The arc tube 12 is suitably supported within a protective outer envelope 18 by means of a supporting frame 20 which is connected to one lead-in conductor 22 sealed through a conventional stem press arrangement 24 for connection to the conventional lamp base 26. The other lead-in conductor 28 connects to the other lamp electrode 14. Electrical connection to the uppermost electrode 14 is made through the frame 20 and a resilient braided connector 30 to facilitate expansion and contraction of the arc tube 12 and the frame 20 is maintained in position within the bulb by suitable metallic spring spacing members 32 which contact the inner surface of the dome portion of the protective envelope 18. As a discharge-sustaining filling, the arc tube contains a small controlled charge of sodium-mercury amalgam and a low pressure of inert ionizable starting gas such as 20 torrs of xenon.

The high-pressure mercury-vapor lamp 34 as shown in FIG. 2 is also generally conventional and comprises a light transmitting arc tube 36 which is usually fabricated of quartz having the operating electrodes 38 operatively supported therein proximate the ends thereof and adapted to have an elongated arc discharge maintained therebetween. The conventional supporting frame 40 serves to suitably support the arc tube within the protective outer envelope 42 and to provide electrical connection to one of the electrodes. The other electrode is connected directly to one of the lead-in conductors 44 and thence to the base 46 so that the combination provides means for connecting the lamp electrodes 38 to an energizing power source. As is conventional, the lamp contains a small charge of mercury 48 which together with an inert ionizable starting gas comprises a radiation-sustaining filling. In this lamp embodiment, ribbon seals 50 provided at the ends of the arc tube 36 facilitate sealing the lead-in conductors therethrough in order to connect to the electrodes.

In FIG. 3 is shown an enlarged fragmentary view of an electrode suitable for use in an HID lamp. The electrode comprises an elongated refractory metal member 52 having one end portion thereof 54 which is adapted to be supported proximate an end of the lamp arc tube with the other end portion 56 of the metal member adapted to project a short distance inwardly within the arc tube. An overfitting refractory metal coil means 58 is carried on the elongated metal member 52 proximate the end 56 thereof. As a specific example, the elongated metal member is formed as a tungsten rod having a diameter of approximately 0.032 inch (0.8 mm) and the overfitting coil 58 as shown in FIG. 3 comprises eight turns of tungsten wire which has a diameter of 0.016 inch (0.4 mm). The outer diameter of the coil 58 can vary from 0.09 inch (2.29 mm) to 0.11 inch (2.8 mm).

The electrode coil in a state of assembly is shown in FIGS. 4 and 5 wherein the elongated refractory metal member 52 has a first inner coil 60 wrapped directly thereon and having such pitch between individual turns intermediate the coil ends 62 that there exists a predetermined spacing between the centrally disposed turns 64. As a specific example, the spacing between the centrally disposed individual turns 64 is approximately equal to the diameter of the wire from which the inner coil is formed. This spacing forms a protected repository for the majority of the emission material 66 which is carried by the electrode structure. An electrode construction such as the foregoing is generally known in the art, as disclosed in U.S. Pat. No. 3,170,081 dated Feb. 16, 1965.

In accordance with the present invention, the electron emissive material 66 is a solid solution of dibarium calcium tungstate ($Ba_2CaWO_6$) and dibarium calcium molybdate ($Ba_2CaMoO_6$) and both of these material have similar "perovskite"-like structures. A solid solution series prepared between the two end members displayed in all cases the same perovskite-like structure. In accordance with the present invention, the gram-molecular ratio of tungstate to molybdate is from 9:1 to 1:9 and preferably the molar ratio of tungstate to molybdate falls within the range of from 1:1 to 1:4. In preparing the solid solution, the end members can be mixed in finely divided form in the relative molecular ratios as desired and fired in a 3-step firing procedure; for example, a suitable schedule comprises a first firing for two hours at 800° C., a second firing for 2 hours at 1200° C. and a final firing for 2 hours at 1350° C., with all firings conducted in an air atmosphere and thorough mixing between each firing step. The final material is reduced to very finely divided form for which a representative particle size is about eleven microns, and the material is formed into a thick paste using an alcohol vehicle. This paste is then applied over the innermost coil 60, as shown in FIG. 4. After drying, the outer coil 68 as shown in FIG. 5 is screwed in place over the inner coil which provides a substantial degree of protection to prevent the electron emissive material 66 from becoming dislodged. The lamp electrodes are then mounted within the arc tube in conventional fashion and the lamp is completed. The actual amount of emission material can vary and for a typical electrode as described hereinbefore, approximately 60 to 70 mg of emission material incorporated in each electrode for a 400 watt lamp provides excellent performance.

The solid solution materials have certain advantages over other types of electrodes, including those electrodes which incorporate as emissive material the end members of the foregoing solid solutions. For example, in general for any given temperature, the vapor pressures of solid solutions are lower than the vapor pressures of the end members thereof. Compared to an electrode which incorporated dibarium calcium tungstate, under controlled conditions with an operating current of 3 amperes, the tip of an electrode tip which utilized an atom ratio of tungstate to molybdate of 3:1 operated at 1540° C. as compared to the "control" dibarium calcium tungstate electrode which operated at a tip temperature of 1555° C. In addition, the voltage drop for the foregoing solid solution electrode was 0.1 volt less than the control electrode, indicating improved emissivity. In a second test wherein the ratio of tungstate to molybdate was 1:3, the electrode tip temperature was 1510° C. and the electrode voltage drop was 10.7 volts versus 11.8 for the control dibarium calcium tungstate-containing electrode. This improved emissivity is probably explainable by the increased barium which is present in the dibarium calcium molybdate as compared to the tungstate.

The foregoing solid solution electrode materials are quite stable with respect to absorption of moisture and gas and as a result, are easy to handle during lamp fabrication. While the dibarium calcium tungstate is a relatively stable material, the solid solutions of tungstate and molybdate have been found to be even more stable. While all solid solutions within the indicated molar range of 9:1 to 1:9 are quite satisfactory, it is preferred to use a relatively high molybdate content to take advantage of the increased emissivity, lower average electrode tip temperature and minimal gas absorption during lamp making. As a result, the preferred molar ratio of tungstate to molybdate is from 1:1 to 1:4.

I claim:

1. In combination with a high-intensity vapor discharge lamp comprising a radiation-transmitting arc tube having electrodes operatively supported therein proximate the ends thereof and adapted to have an elongated arc discharge maintained therebetween, and means for connecting said electrodes to an energizing power source, the improved structure for said electrodes each of which comprises:

(a) an elongated refractory metal member having one end portion thereof supported proximate an end of said arc tube and the other end portion of said metal member projecting a short distance inwardly within said arc tube, and overfitting refractory metal coil means carried on the inwardly projecting portion of said elongated metal member; and (b) electron emissive material carried intermediate turns of said overfitting coil means, said electron emissive material consisting essentially of a solid solution of dibarium calcium tungstate ($Ba_2CaWO_6$) and dibarium calcium molybdate ($Ba_2CaMoO_6$) wherein the molar ratio of said tungstate to said molybdate falls within the range of from 9:1 to 1:9.

2. The combination as specified in claim 1, wherein said high-intensity discharge lamp is a high-presssure sodium-mercury vapor lamp.

3. The combination as specified in claim 1, wherein said high-intensity discharge lamp is a high-intensity mercury-vapor discharge lamp.

4. The combination as specified in claim 1, wherein said overfitting coil means comprises a first inner coil wrapped directly on said elongated refractory metal member and having such pitch between individual turns intermediate the coil ends that there exists a predetermined spacing between such individual turns, and a second coil overfitting said first coil and having a tight spacing between individual turns thereof, and said electron emissive material carried between said spaced individual turns of said first coil intermediate the ends thereof.

5. The combination as specified in claim 4, wherein the molar ratio of said tungstate to said molybdate falls within the range of from 1:1 to 1:4.

* * * * *